US009389032B2

(12) United States Patent
Daley, Jr.

(10) Patent No.: US 9,389,032 B2
(45) Date of Patent: Jul. 12, 2016

(54) UPPER RECEIVER WEAR SURFACE

(71) Applicant: Sig Sauer, Inc., Newington, NH (US)

(72) Inventor: William C. Daley, Jr., Kingston, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 14/669,192

(22) Filed: Mar. 26, 2015

(65) Prior Publication Data

US 2015/0276335 A1 Oct. 1, 2015

Related U.S. Application Data

(60) Provisional application No. 61/971,129, filed on Mar. 27, 2014.

(51) Int. Cl.
*F41A 3/66* (2006.01)
*F41A 3/72* (2006.01)

(52) U.S. Cl.
CPC ... *F41A 3/66* (2013.01); *F41A 3/72* (2013.01); *Y10T 29/49826* (2015.01)

(58) Field of Classification Search
CPC ..... F41A 3/66; F41A 3/72
USPC ..... 42/75.01, 75.03, 75.02; 89/1.4
See application file for complete search history.

(56) References Cited

U.S. PATENT DOCUMENTS 1,574,770 A * 3/1926 Von Frommer ..... F41A 3/72 42/16
3,225,653 A * 12/1965 Packard ..... F41A 3/72 42/16
7,240,600 B1 * 7/2007 Bordson ..... F41A 3/72 42/69.01
7,707,921 B1 * 5/2010 Hoel ..... F41A 35/06 42/16
7,832,322 B1 * 11/2010 Hoel ..... F41A 3/20 42/16
8,104,393 B2 * 1/2012 Kincel ..... F41A 3/72 42/16
8,820,210 B2 * 9/2014 Melville ..... F41A 3/72 42/69.01
D724,688 S * 3/2015 Hirt ..... D22/108
D725,213 S * 3/2015 Hirt ..... D22/103
D725,219 S * 3/2015 Hirt ..... D22/108
D725,220 S * 3/2015 Hirt ..... D22/108
2007/0033851 A1 * 2/2007 Hochstrate ..... F41A 5/18 42/75.01
2009/0064556 A1 * 3/2009 Fluhr ..... F41A 19/34 42/14
2011/0174139 A1 * 7/2011 Olsen ..... F41A 35/06 89/1.4
2014/0000142 A1 * 1/2014 Patel ..... F41C 23/16 42/14
2015/0233657 A1 * 8/2015 Barker ..... F41A 35/06 89/1.4
2015/0362270 A1 * 12/2015 Stewart ..... F41A 3/66 42/16

* cited by examiner

*Primary Examiner* — Joshua Freeman
(74) *Attorney, Agent, or Firm* — Finch & Maloney PLLC

(57) ABSTRACT

A firearm receiver wear surface is disclosed. When inserted within a corresponding wear surface cavity in a firearm receiver, a wear surface pin contacts and engages with the hook of a charging handle latch. In one example, a wear surface cavity for receiving a wear surface pin may be machined within the upper receiver of a modular rifle. The positioning of the wear surface cavity and wear surface pin can prevent the charging handle latch from contacting and causing unwanted wear on the upper receiver. In some embodiments, the wear surface pin may be a replaceable pin-shaped object made from a more durable material than the material of the upper receiver. For example, the wear surface pin may be a steel coiled spring pin that is pressure-fit into a wear surface cavity in an aluminum alloy upper receiver.

21 Claims, 7 Drawing Sheets

UPPER RECEIVER WEAR SURFACE

CROSS-REFERENCE TO RELATED APPLICATIONS

This application claims the benefit of U.S. Provisional Patent Application No. 61/971,129, filed on Mar. 27, 2014, which is herein incorporated by reference in its entirety.

FIELD OF THE DISCLOSURE

The disclosure relates to firearms and more particularly to features of a firearm receiver.

BACKGROUND

Firearm design involves a number of non-trivial challenges, including the design of external features of a receiver and the interaction between the various firearm components. The outer body of a firearm receiver can include, for example, features for contacting and engaging with a charging handle latch. Considerations related to the design of firearm receivers may include the interaction between the receiver and the charging handle latch.

SUMMARY

One example embodiment provides a firearm receiver, the firearm receiver including: an upper receiver frame; an inner surface of the upper receiver frame contoured to define a component housing cavity within the upper receiver frame for housing a shaft portion of a charging handle; an outer surface of the upper receiver frame contoured to define at least one wear surface cavity penetrating a portion of the upper receiver frame; and at least one wear surface pin secured within the at least one wear surface cavity such that an exposed portion of the wear surface pin is positioned to engage with a charging handle latch. In some cases, the at least one wear surface cavity includes two wear surface cavities each one configured to secure a portion of one of the at least one wear surface pin such that an exposed portion of the at least one wear surface pin engages with one of a right handed and/or left handed charging handle latch. In some cases, the at least one wear surface pin is composed of a material having higher resistance to wear than a material of the upper receiver frame. In some cases, the at least one wear surface pin is composed of a different material than the upper receiver frame. In some cases, the at least one wear surface pin includes at least one of a solid metal pin, a hollow metal pin, a coiled spring pin, and/or a slotted spring pin. In some such cases, a portion of the at least one wear surface pin is configured to be pressure-fit within the at least one wear surface cavity. In some cases, the at least one wear surface pin is a threaded pin-shaped object configured to be screwed into the at least one wear surface cavity. In some cases, the exposed portion of the at least one wear surface pin prevents contact between the charging handle latch and the outer surface of the upper receiver frame. In some cases, the outer surface and the inner surface of the upper receiver frame are conformed to access each other via the wear surface cavity. In some cases, a firearm includes the firearm receiver.

Another example embodiment provides a method of installing a wear surface pin, the method including: forming a wear surface cavity into an upper receiver, wherein the wear surface cavity penetrates a portion of the upper receiver; and inserting a wear surface pin into the wear surface cavity such that a portion of the wear surface pin is exposed and positioned to engage with a charging handle latch. In some cases, forming a wear surface cavity includes forming two wear surface cavities on opposing sides of the upper receiver, and inserting a wear surface pin includes inserting two wear surface pins, one into each of the two wear surface cavities such that an exposed portion of each of the two wear surface pins engages with a right handed or left handed charging handle latch. In some cases, forming a wear surface cavity includes drilling or milling a substantially cylindrical cavity configured to receive a wear surface pin. In some cases, forming a wear surface cavity further includes drilling or milling a countersink at the opening of the wear surface cavity. In some cases, the method further includes removing the wear surface pin from the wear surface cavity; and inserting a second wear surface pin into the wear surface cavity such that a portion of the second wear surface pin is exposed and positioned to engage with the charging handle latch. In some cases, inserting a wear surface pin into the wear surface cavity includes inserting at least one of a solid metal pin, a hollow metal pin, a coiled spring pin, and/or a slotted spring pin into the wear surface cavity.

Another example embodiment provides firearm receiver, the receiver including: an inner surface contoured to define a component housing cavity for housing a shaft portion of a charging handle; and an outer surface contoured to define a wear surface cavity for securing a portion of a wear surface pin such that an exposed portion of the wear surface pin engages with a charging handle latch. In some cases, the outer surface of the firearm receiver is contoured to define two wear surface cavities, each one configured to secure a portion of one of two wear surface pins such that an exposed portion of each wear surface pin engages with a right handed and/or left handed charging handle latch. In some cases, a firearm includes the firearm receiver. In some cases, the firearm receiver is the upper receiver of a modular rifle.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

Figure 1A:
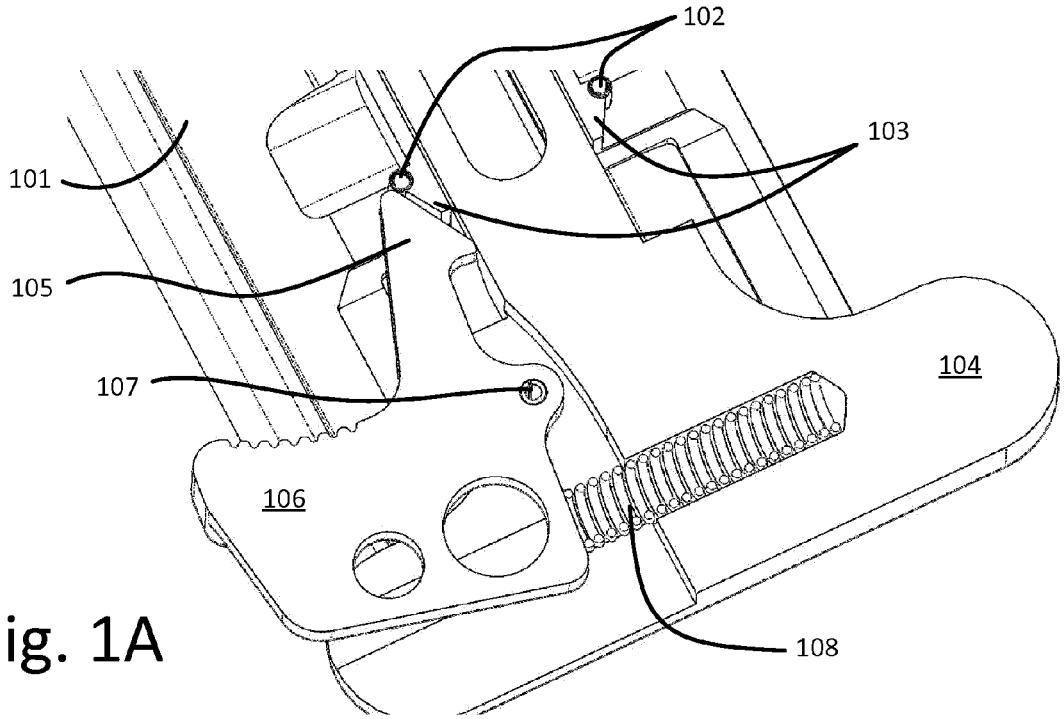
FIGS. 1A-1D each illustrate a cross-sectional isometric view of a wear surface pin installed within a firearm upper receiver, in accordance with an embodiment of the present invention.

These and other features of the present embodiments will be understood better by reading the following detailed description, taken together with the figures herein described. In the drawings, each identical or nearly identical component that is illustrated in various figures may be represented by a like numeral. For purposes of clarity, not every component may be labeled in every drawing. Furthermore, as will be appreciated, the figures are not necessarily drawn to scale or intended to limit the claimed invention to the specific configurations shown. In short, the figures are provided merely to show example structures.

DETAILED DESCRIPTION

A wear surface pin is disclosed which, when inserted within a corresponding wear surface cavity in the frame of a firearm receiver, contacts and engages with the latch hook of a charging handle latch. A firearm charging handle allows a user to manually pull the bolt to the rear (toward the stock) of the firearm in order to charge the weapon and/or open the chamber. In one embodiment, a wear surface cavity may be formed within a firearm receiver, and more specifically the upper receiver of a modular rifle, and positioned to receive a wear surface pin that will contact and engage with the spring-loaded latch of a charging handle. The positioning of the wear surface cavity and wear surface pin can prevent the charging handle latch from contacting and causing unwanted wear on the upper receiver. In some embodiments, the wear surface pin may be a replaceable pin-shaped object made from a more durable material than the material of the upper receiver. In some cases, the upper receiver may be composed of an aluminum or magnesium alloy, a carbon polymer, or an aramid polymer. For example, the wear surface pin may be a steel coiled spring pin that is pressure-fit into a wear surface cavity in the frame of an aluminum upper receiver, according to one embodiment.

General Overview

As previously indicated, there are a number of non-trivial issues related to the design and components associated with a firearm receiver. One such issue relates to friction and wear between the latch of a charging handle and the upper receiver. Charging handles generally include a shaft portion and a spring-loaded charging handle latch positioned at the rear of the shaft. When the charging handle is in the forward position (toward the muzzle of the weapon), a hook portion on the charging handle latch engages with an angled feature or other protrusion on the upper receiver and secures the charging handle in place against the spring bias. A feature at the forward end of the charging handle shaft engages with the bolt carrier group for manually pulling the bolt to the rear. In one example, the weapon may be manually charged by disengaging the charging handle latch and pulling the charging handle to the rear, carrying the bolt carrier group with it. The bolt carrier group is powered by a recoil spring and when the charging handle is released, the recoil spring propels the bolt carrier group to its forward position and charges a round into the chamber or closes an empty chamber. In such an example, the charging handle is pulled forward along with the bolt carrier group and secured in its forward position by the charging handle latch. A portion of the bolt carrier group (e.g., the gas carrier key) may be positioned within a groove along the charging handle shaft, allowing the bolt carrier group to travel independently along the groove while the charging handle is secured in its forward position. When a round is discharged, the bolt carrier group can recoil along this groove and return to its forward position while the charging handle remains secured by the charging handle latch. While the upper receiver is typically machined or forged aluminum or anodized aluminum, the charging handle latch is often steel or some other durable metal that is harder than aluminum. In other embodiments, the charging handle latch is also made of an aluminum alloy similar to or the same as that used for the upper receiver. Friction between the charging handle latch and the upper receiver may be caused by charging the weapon, opening the chamber, not fully disengaging the charging handle latch before pulling back on the charging handle, and/or recoil forces from firing the weapon. Wear on the upper receiver may increase in cases where a charging handle latch is made of a more durable material than that of the upper receiver. Enough wear to the upper receiver may result in latch failure and may allow the charging handle to move rearwards and possibly strike a user in the face while firing the weapon. While a charging handle latch is relatively inexpensive and easily replaced, sufficient wear to the upper receiver may require a costly replacement of the entire upper receiver.

Thus, in accordance with an embodiment of the present invention, an upper receiver wear surface pin is disclosed to reduce wear on an upper receiver caused by a charging handle latch. In one embodiment, the wear surface pin may be installed within a wear surface cavity in the frame of the upper receiver and positioned to concentrate on itself any friction from the charging handle latch. In some embodiments, the wear surface pin may be made of a stronger or harder material than the upper receiver (which is typically an aluminum alloy); and should the pin show signs of deterioration or wear it may be replaced, thus reducing the risk of significant system failure should the upper receiver be compromised. In one example, the wear surface pin is a replaceable steel pin positioned such that the charging handle latch does not make any contact with the aluminum or anodized aluminum of an upper receiver. In another example, the wear surface pin is the same material as the charging handle latch. The wear surface pin may be, for example, a solid or hollow pressure fit pin or dowel, such as a coiled or slotted spring pin, and may be pressed into the wear surface cavity of the upper receiver with an interference fit. In one such embodiment, the wear surface pin can be replaced by pressing it deeper into the wear surface cavity until it falls through the cavity (e.g., into a cavity within the frame of the upper receiver) for removal. In other embodiments, the wear surface pin can be a threaded pin with a drive feature at one end (such as a Phillips or Hex socket) which allows the pin to be installed and/or removed like a screw. In still other embodiments, the wear surface pin may be received in a wear surface cavity of the upper receiver and captured in position by assembly of another component to the upper receiver. In some embodiments, the wear surface cavity is anodized prior to installation of the wear surface pin, creating an insulating barrier and helping prevent galvanic corrosion or electrolysis.

In accordance with some embodiments, the wear surface cavity within the frame of the upper receiver is about 0.53" deep, has a diameter of about 0.062" to 0.081", a countersink diameter of about 0.080" to 0.130", and a chamfer angle of about 60° to 90°. The wear surface pin, in one example, is a pin about 7/16" (0.437") long designed to fit within the wear surface cavity such that the uppermost portion of the pin is recessed slightly below the top of the upper receiver. After half an inch, the wear surface cavity intersects with a larger cavity within the frame of the upper receiver, in this example embodiment, and the wear surface pin may be pushed through to this cavity for removal and replacement. A pressure-fit pin may be inserted or removed, for example, using a punch tool or pin driver. In some cases, the material used for the wear surface pin may be chosen based on the material's resistance to wear and deterioration. The wear surface pin may be aluminum, in some embodiments; however, due to aluminum's relative softness compared to other metal alloys, such pins may require more regular replacement and maintenance and may become distorted when being pressure fit into the wear surface cavity. Aluminum alloys are typically used to manufacture the upper receivers of various firearms, and a wear surface pin that is more durable than the material of the upper receiver may be desirable. For example, a wear surface pin made out of a steel or titanium alloy will provide a more wear resistant contact point for the charging handle latch than an aluminum angled feature formed on the upper receiver. As will be appreciated, various cavity and/or countersink dimensions may be used, in other embodiments, and the present disclosure is not intended to be limited to any particular set of cavity and/or wear surface pin dimensions.

Whether the charging handle latch contacts any portion of the upper receiver may depend on several factors, including the location of the wear surface pin (i.e., the location of the wear surface cavity within the frame of the upper receiver), the dimensions of any angled features on the upper receiver, and/or the shape of the hook portion of the charging handle latch. In one embodiment, the location of the wear surface pin as well as the design of the latch hook can eliminate any contact between the charging handle latch and the angled feature of the upper receiver, while in other embodiments, the charging handle latch may contact a first portion of the angled feature before contacting the wear surface pin. In order to accommodate charging handles that may have a latch on the right, left, or both sides of the charging handle, two wear surface cavities may be formed within an upper receiver, one on each side of the charging handle. In some embodiments, the wear surface cavities may be formed during the initial casting or machining process used to create the upper receiver, or an already fabricated upper receiver may be retrofit to receive a replaceable wear surface pin. In one example, when the angled feature of an upper receiver becomes worn down after extensive use and no longer functions to engage the charging handle latch, the upper receiver may be repaired by machining a wear surface cavity and installing a wear surface pin.

Although the various wear surface pins described herein have a substantially cylindrical configuration, the wear surface pins and corresponding wear surface cavities are not intended to be limited to any particular shape or design. For example, in various embodiments the wear surface pin may be tapered, may have a substantially rectangular cross section, or have different shapes along its length. In one embodiment, the exposed portion of the pin that engages with the latch may have different shapes to provide a different latching feel. For example, a wear surface pin with a circular cross section having a relatively large radius will provide a smooth latching motion when the hook of the charging handle latch contacts the wear surface pin and engages with it. In contrast, a wear surface pin with a rectangular cross section or other sharp angles will provide a more harsh latching motion when the hook of the charging handle contacts and engages with the wear surface pin.

Numerous other configurations and variations will be apparent in light of this disclosure. The upper receiver wear surface pin may be implemented in various rifles (e.g., the SIG516® rifle) and various machine/submachine guns (e.g., the SIG MPX™ submachine gun), just to name a few firearm examples (note that the specific firearm examples provided are all produced by Sig Sauer, Inc.). However, the upper receiver wear surface techniques variously disclosed herein are not intended to be limited for use with any particular firearm, unless otherwise indicated.

Wear Surface Examples

FIGS. 1A-1D each illustrates a cross-sectional isometric view of a wear surface pin installed within a firearm upper receiver, in accordance with an embodiment of the present disclosure. FIG. 1A provides a rear overhead view of the charging handle 104 moving to the forward position and the latch hook 105 of charging handle latch 106 making initial contact with a wear surface pin 102. A portion of the upper receiver 101 can be seen, in this example, with an angled feature 103 integral to the upper receiver 101 positioned on each side of the charging handle 104. In this example, the wear surface pins 102 are pin-shaped objects fastened into the upper receiver 101 just forward of the angled features 103. In this particular example, the charging handle 104 includes only one charging handle latch 106 on the left side; however, many types of charging handles exist with charging handle latches on the right, left, or both sides of the charging handle. In order to accommodate such charging handle types, two wear surface pins 102 have been installed into the upper receiver 101, in this embodiment, one on each side of the charging handle 104. The charging handle latch 106 is held within the charging handle 104 with a charging handle latch pin 107. The charging handle latch 106 may rotate around the latch pin 107 when a user pulls on the charging handle latch 106, or when the charging handle 104 is moving to the forward position and the latch hook 105 contacts the wear surface pin 102. When a user pulls on the charging handle latch 106, it rotates around the latch pin 107 and compresses the charging handle latch spring 108, thus disengaging the latch hook 105 from the wear surface pin 102 and allowing the user to pull back the charging handle. In some embodiments, the angled feature 103 may act as a ramp to help the latch hook 105 rotate around the wear surface pin 102 as the charging handle 104 moves toward the forward position. However, in this particular example, the latch hook 105 is positioned such that there is no contact between the latch hook 105 and the angled feature 103 of the upper receiver 101, and in such cases the upper receiver 101 may not have an angled feature at all. As discussed above, whether the latch hook 105 contacts the angled feature 103 may depend on the location of the wear surface pin 102, the dimensions of the angled feature 103, as well as the shape of the latch hook 105. The charging handle 104, in this example figure, is traveling forward along the upper receiver 101 and the tip of the latch hook 105 is contacting the wear surface pin 102. The wear surface pin 102 is positioned such that the latch hook 105 does not contact the angled feature 103 and therefore causes no friction or wear on the upper receiver 101.

Figure 1B:
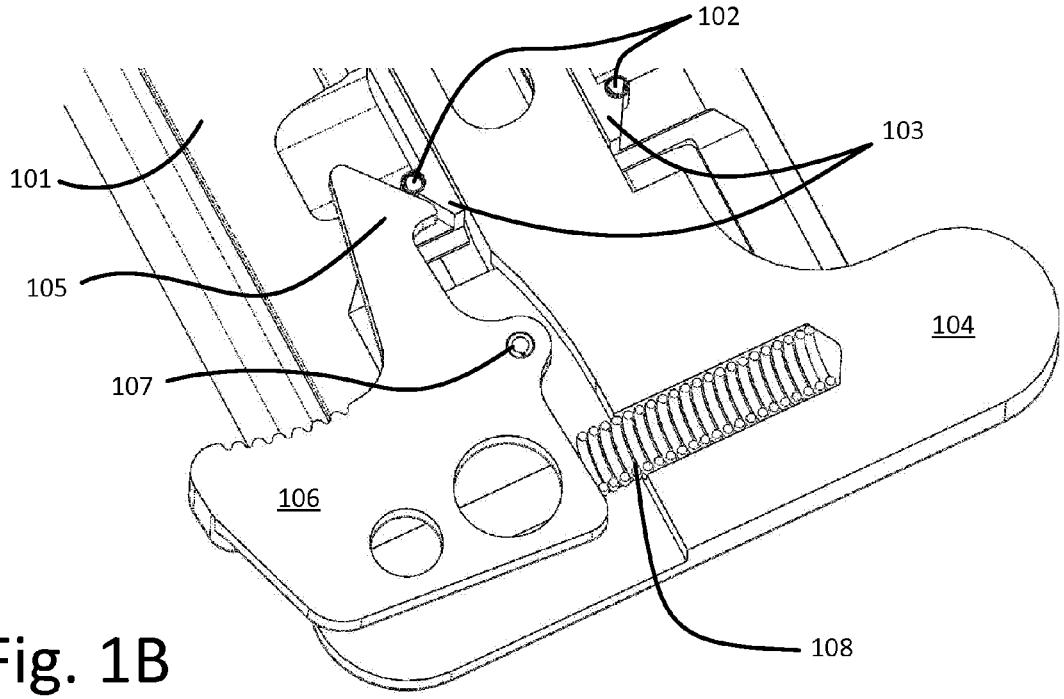
Figure 1C:
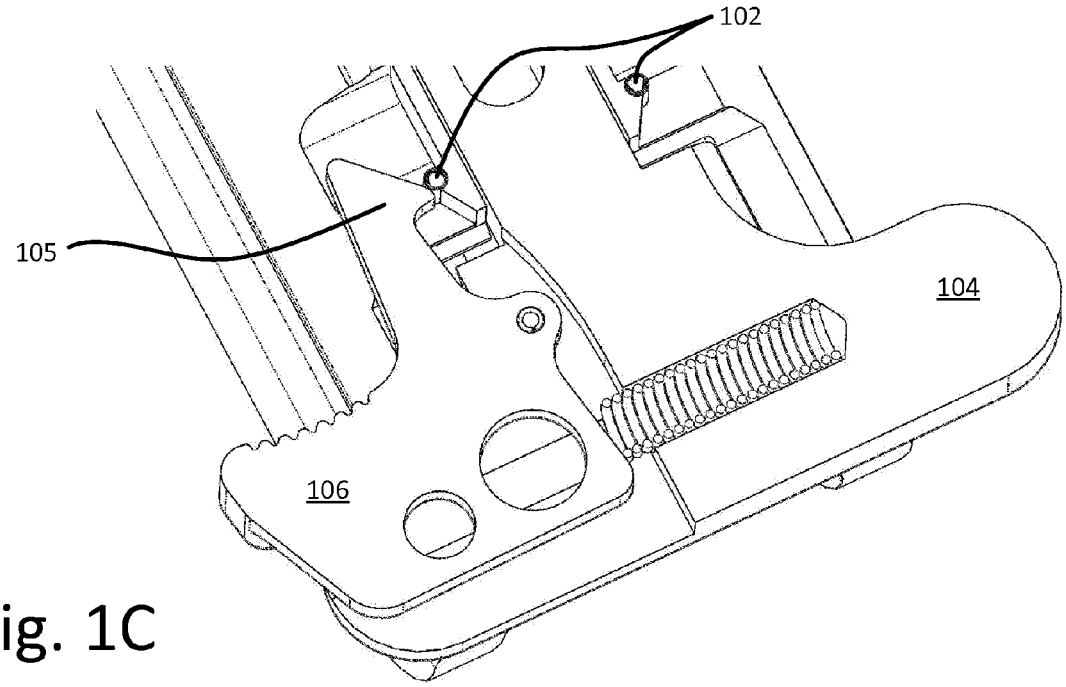
Figure 1D:
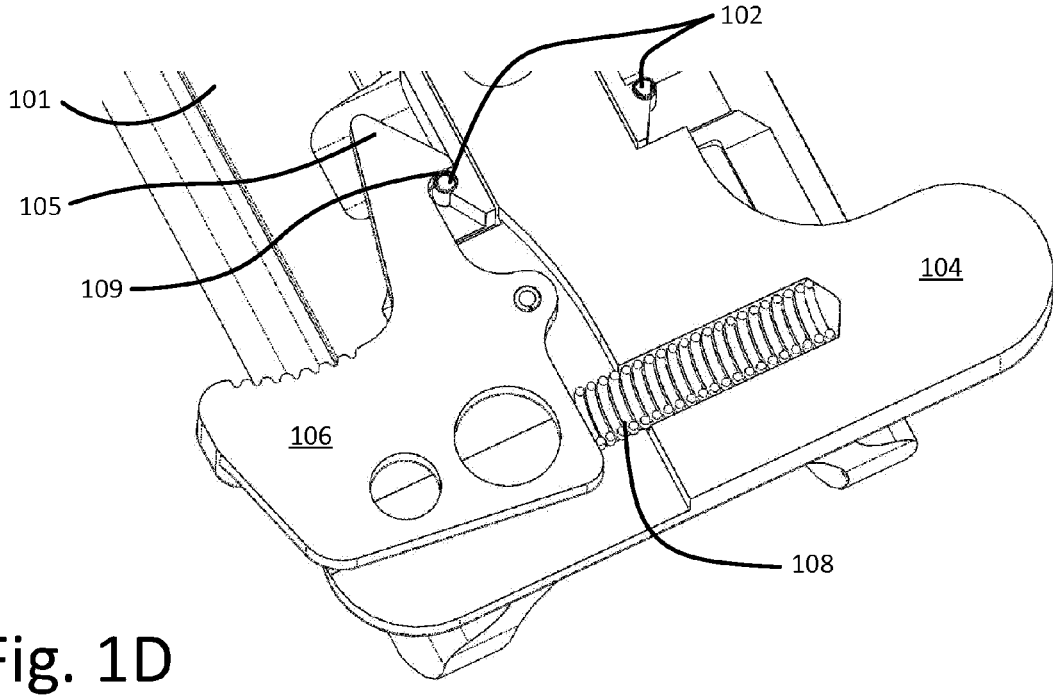

FIGS. 1B and 1C provide rear overhead views of the charging handle 104 and upper receiver 101 shown in FIG. 1A as the charging handle 104 continues moving toward the forward position. As can be seen in FIG. 1B, the latch hook 105 rides over the wear surface pin 102 as the charging handle 104 moves forward. The charging handle latch 106 rotates around the charging handle pin 107 and compresses the charging handle latch spring 108 as the latch hook 105 rotates around the wear surface pin 102. In this example, the latch hook 105 only makes contact with the wear surface pin 102 and no friction or wear is created between the latch hook 105 and the angled feature 103 of the upper receiver 101. FIG. 1C shows the latch hook 105 as it is about to clear the wear surface pin 102. FIG. 1D provides a rear overhead view of the charging handle 104 and upper receiver 101 shown in FIG. 1A after the charging handle latch 106 has engaged the wear surface pin 102. When the charging handle 104 is secured in the forward position, pressure from the spring 108 causes the latch hook 105 to engage with the wear surface pin 102 and prevent the charging handle 104 from moving backward. In some embodiments, the contact point 109 between a forward portion of the wear surface pin 102 and the inner portion of the latch hook 105 receives a significant amount of friction and wear due to recoil from firing the weapon. In such embodiments, recoil wear from firing the weapon is limited to the wear surface pin 102 when the charging handle 104 is in the forward position, as shown in FIG. 1D, thus preventing wear on the upper receiver 101.

Figure 2A:
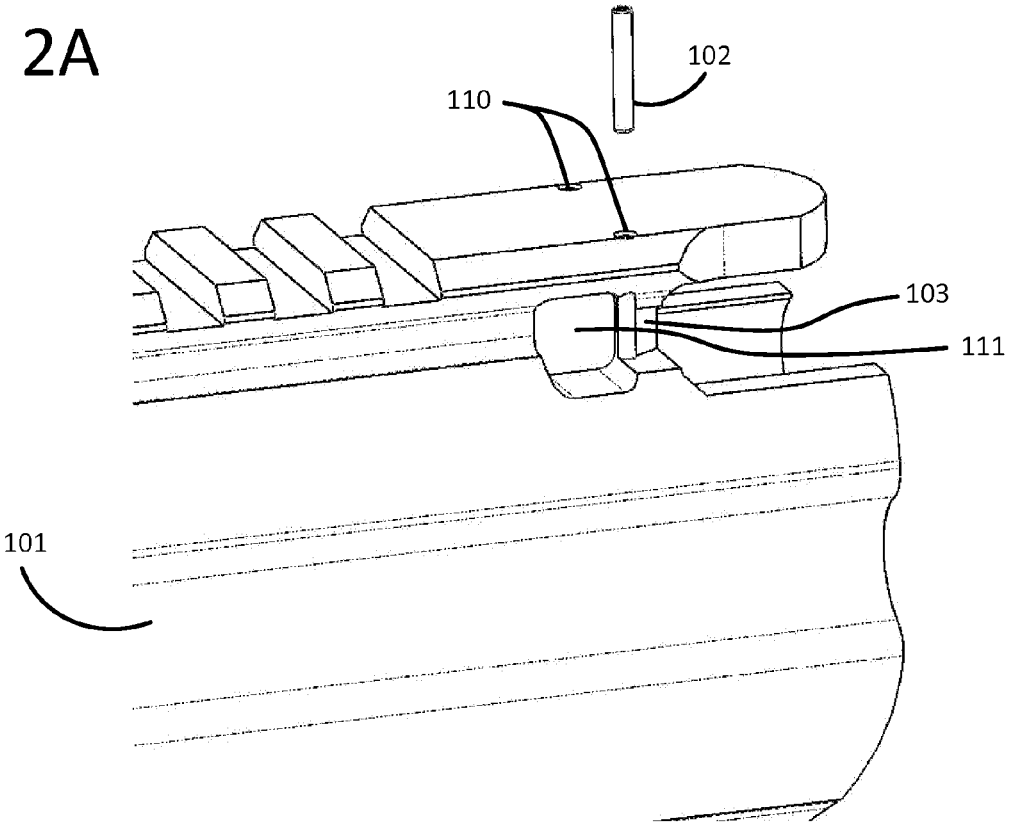
FIGS. 2A-2C each illustrate an isometric view of a firearm upper receiver configured to receive a wear surface pin, in accordance with an embodiment of the present invention.
Figure 2B:
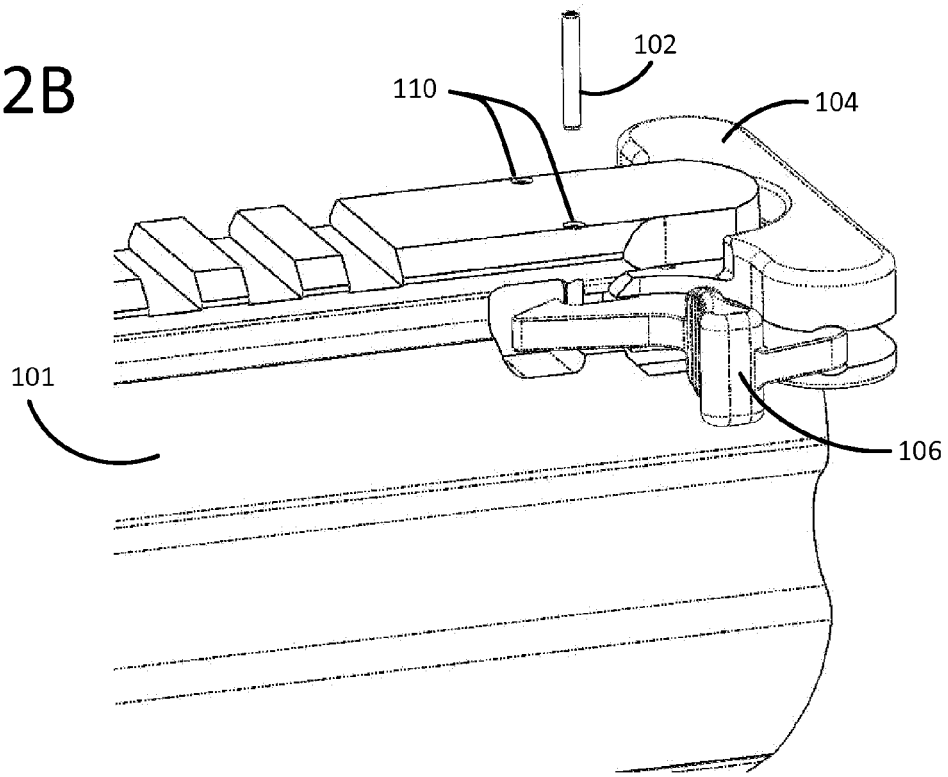
Figure 2C:
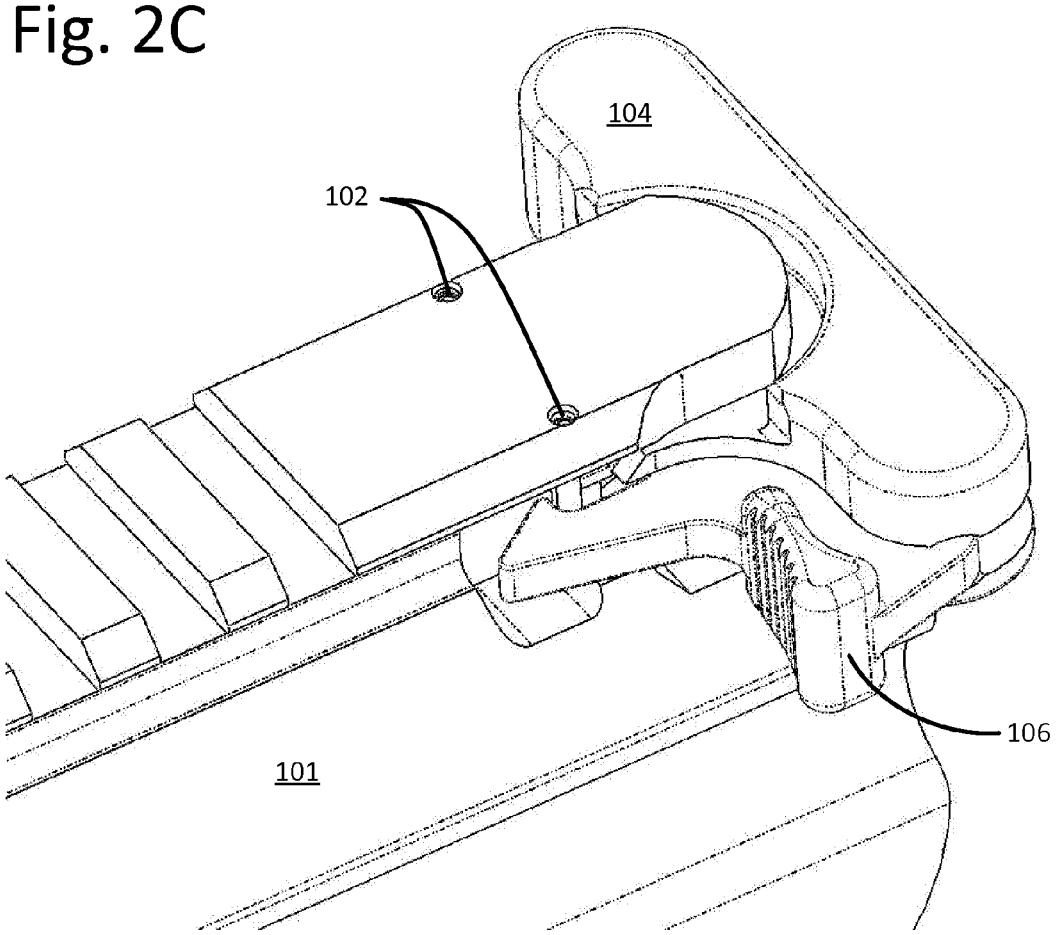

FIGS. 2A-2C each illustrates an isometric view of a firearm upper receiver configured to receive a wear surface pin, in accordance with an embodiment of the present invention. FIG. 2A shows a left side view of the upper receiver 101 with the wear surface pin 102 above its corresponding wear surface cavity 110. The upper receiver 101, in this embodiment, includes an angled feature 103, a cavity 111 for receiving the hooked portion of a charging handle latch when the charging handle is latched in the forward position, and two wear surface cavities 110 for insertion of a wear surface pin 102. In some embodiments, a wear surface pin 102 may be inserted into each of the wear surface cavities 110 such that a right and/or left handed charging handle latch may be used, as discussed above. As also previously mentioned, the location of the wear surface cavities 110 within the frame of the upper receiver 101 may determine whether a charging handle latch contacts the angled feature 103. In some embodiments, the various cavities or features of the upper receiver 101 may be formed during the initial casting or machining process used to create the upper receiver 101. In other embodiments, one or more wear surface cavities 110 can be formed within an already fabricated upper receiver 101, possibly one where the angled feature 103 that has been worn down by repeated contact with a charging handle latch. FIG. 2B shows a left side view of the upper receiver 101 shown in FIG. 2A with the addition of a charging handle 104 in the forward latched position. The charging handle latch 106 is in the latched position, and inserting the wear surface pin 102 into the left-side wear surface cavity 110 on the upper receiver 101 will provide the contact point with which the hook portion of the charging handle latch 106 will engage. FIG. 2C shows an offset overhead view of the upper receiver 101 and charging handle 104 shown in FIG. 2B with the wear surface pin 102 installed within the frame of the upper receiver 101. As can be seen in this example figure, once the wear surface pin 102 is installed within the frame of the upper receiver 101, the charging handle latch 106 holds the charging handle 104 in place, and contact with the charging handle latch 106 is isolated to the wear surface pin 102.

Figure 3:
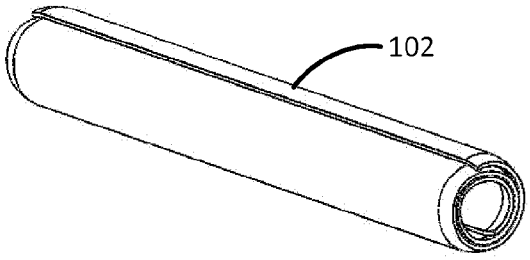
FIG. 3 illustrates an isometric view of an example pin that can be implemented as an upper receiver wear surface pin, in accordance with an embodiment of the present invention.

FIG. 3 illustrates an example pin that can be implemented as an upper receiver wear surface pin, in accordance with an embodiment of the present invention. As can be seen, in this particular example, the wear surface pin 102 is a coiled spring pin about 7/16" (0.437") long and about 1/16" (0.0625") in diameter. The coiled spring pin 102 is substantially hollow, in this embodiment, and is designed to be pressure fit into a wear surface cavity within an upper receiver, as described in reference to FIGS. 2A-2C. In this particular example, the coiled design of pin 102 allows it to compress slightly and apply an expansion pressure on the side walls of the cavity, creating a tight fit. As mentioned above, screw-type pins or other types of pressure fit pins or dowels may be used in other embodiments. For example, the wear surface pin can be a threaded pin with a drive feature (such as a Phillips or Hex socket) at one end that can be installed and/or removed like a screw, or it can be a solid pin pressed into a smaller wear surface cavity. The wear surface pin 102, in this example embodiment, is made of steel or some other material having increased resistance to wear compared to the material of the upper receiver, which is typically an aluminum alloy.

Figure 4:
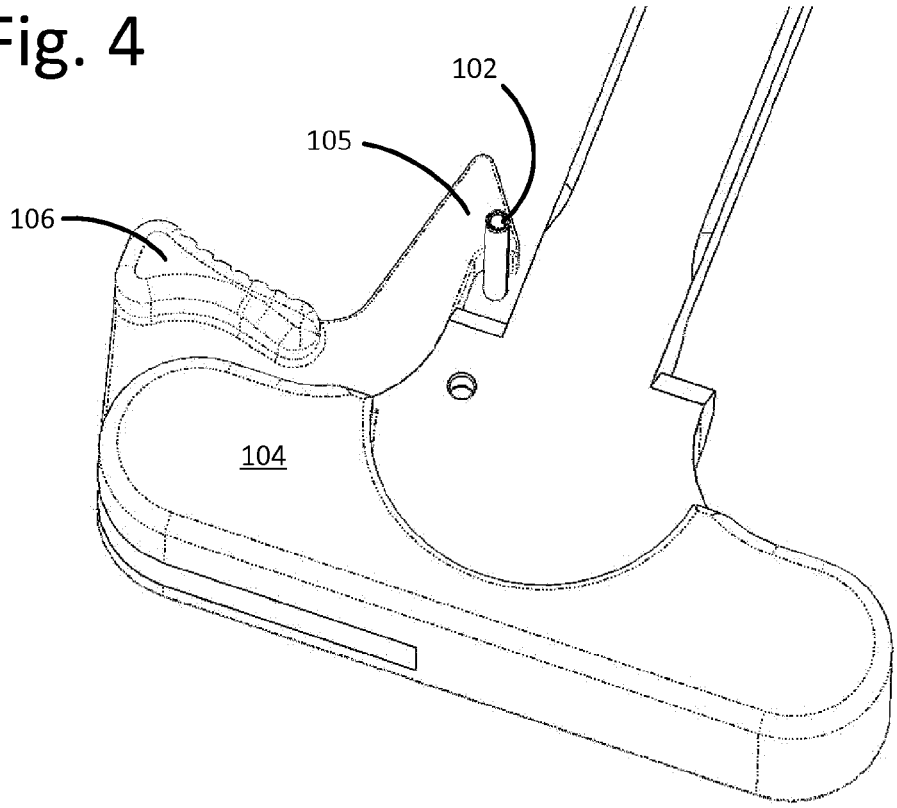
FIG. 4 illustrates an isometric view of a charging handle and a wear surface pin, in accordance with an embodiment of the present invention.

FIG. 4 illustrates an isometric view of a firearm charging handle and wear surface pin, in accordance with an embodiment of the present invention. This example illustrates the interaction between the charging handle latch 106 and the wear surface pin 102. As can be seen, the latch hook 105 is engaging the wear surface pin 102. Friction from discharging the weapon or failing to fully disengage the charging handle latch 106 prior to pulling back on the charging handle 104 will be concentrated on the wear surface pin 102. In some embodiments, the diameter and/or the location of the wear surface pin 102 may be determined based on the shape and/or reach of the latch hook 105 that will engage with the pin 102. For example, if the latch hook 105 has a large reach, the wear surface pin 102 may be placed farther away from the shaft of the charging handle 104. In another example, the wear surface pin 102 may have a smaller diameter if it is designed to engage with a latch hook 105 having an acute hook shape.

Figure 5A:
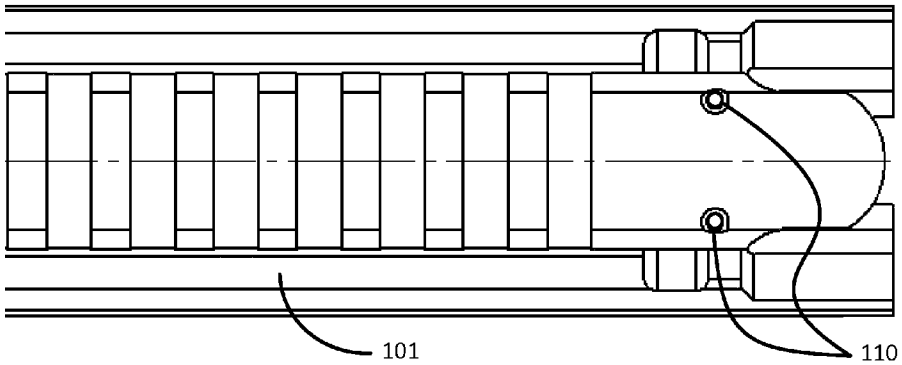
FIG. 5A illustrates an overhead planar view of the rear portion of a firearm upper receiver with wear surface cavities for placement of a wear surface pin, in accordance with an embodiment of the present invention.
Figure 5B:
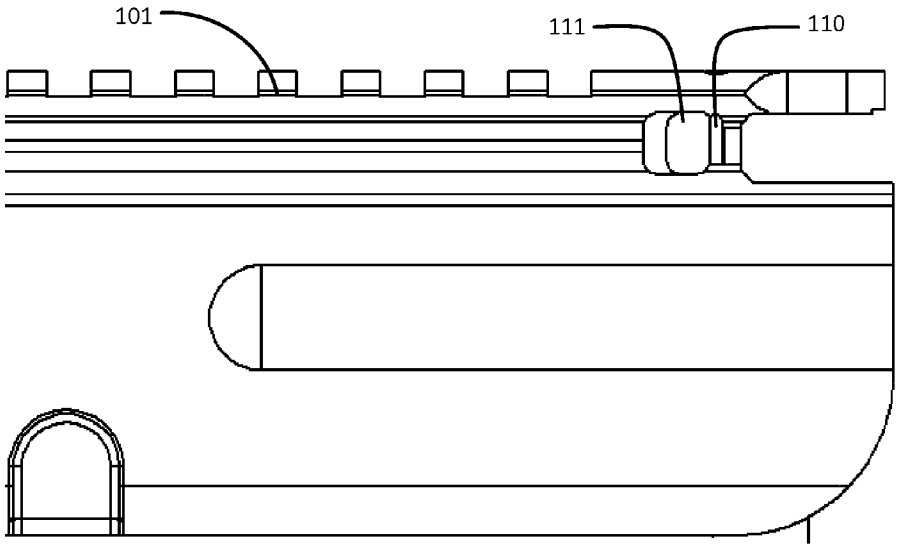
FIG. 5B illustrates a side planar view of the rear portion of a firearm upper receiver with wear surface cavities for placement of a wear surface pin, in accordance with an embodiment of the present invention.

FIGS. 5A and 5B show an overhead and side planar view of a firearm upper receiver. FIG. 5A provides an overhead view of the rear portion of an upper receiver 101 with wear surface cavities 110 for placement and retention of a wear surface pin. As can be seen in this example, the wear surface cavities 110 are substantially cylindrical and designed to house a wear surface pin. FIG. 5B provides a side view of the rear portion of an upper receiver 101 showing a wear surface cavity 110 for placement of a wear surface pin. In this embodiment, a cavity 111 is present in the outer surface of the upper receiver 101 ahead of the wear surface cavity 110. When a charging handle is latched in the forward position, the hook portion of the charging handle latch enters the cavity 111 and engages with an exposed portion of the wear surface pin installed within the wear surface cavity 110. Thus, as shown, the location of the wear surface cavity 110 is just behind the cavity 111.

Figure 6A:
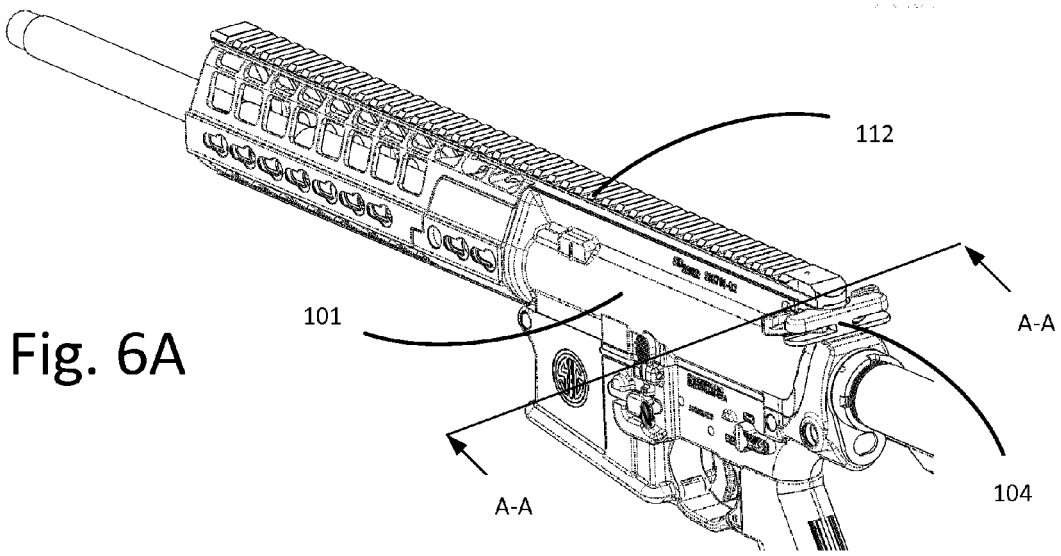
FIG. 6A illustrates an isometric view of a firearm that includes a handguard having an integral accessory mount positioned above a wear surface cavity to capture a wear pin therein.
Figure 6B:
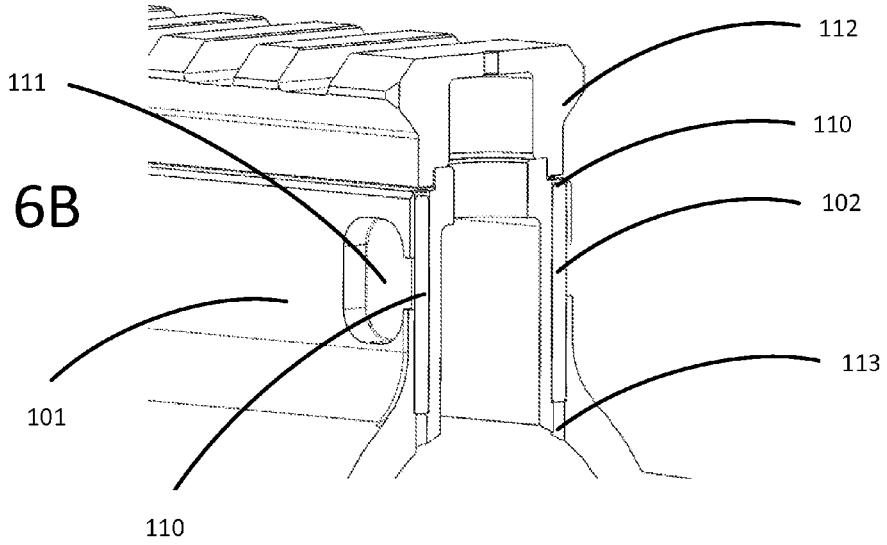
FIG. 6B illustrates a cross-sectional view of firearm embodiment of FIG. 6A, as viewed along arrows A-A shown in FIG. 6A.

FIG. 6A illustrates an isometric view of a firearm that includes a handguard having an integral accessory mount positioned above the upper receiver. FIG. 6B is a cross-sectional view of firearm of FIG. 6A, as viewed along arrows A-A. The upper receiver 101 includes a pair of wear surface cavities 110 configures to receive a wear pin 102 on either lateral side of the receiver 101. An accessory rail of a handguard 112 is mountable to the upper receiver 101 in a manner that covers an upper opening of the wear surface cavity 110. A wear surface cavity access port 113 proves access to the wear surface cavity 110 from within the upper receiver 101, but is formed of a smaller diameter than the wear surface cavity and the wear pin 102. A wear pin 102 may thus may be received through the upper opening of the wear surface cavity, with the handguard 112 disassembled from the upper receiver 101, and then captured within the wear surface cavity by the access port 113 at the lower end of the wear surface cavity 110 and the handguard accessory rail 112 at the upper end of the wear surface cavity 110. In such embodiments, the wear pin 102 may be constructed to have a smaller diameter than the inner diameter of the wear surface a cavity 110, although some degree of interference may also be included. The wear pin may be removed by turning the upper receiver upside down to allow gravity to draw the wear pin 102 from the wear pin cavity with the accessory mount of the handguard 112 in a disassembled state from the receiver. An operator may, additionally or alternately, urge the wear pin 102 from the wear surface cavity 110 by inserting a tool through access port 113 to contact and push the wear pin through the upper opening of the wear surface cavity 110. It is to be appreciated that although FIGS. 6A and 6B illustrate an embodiment having an accessory mount of a handguard that acts to capture the wear pin in the upper receiver, that other components may perform similar functions in other embodiments. By way of non-limiting example, an accessory mount that is separate from a handguard may cover the upper opening of the wear surface a cavity when assembled to the upper receiver, according to other embodiments.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

The indefinite articles "a" and "an" as used herein in the specification and in the claims, unless clearly indicated to the contrary, should be understood to mean "at least one."

The phrase "and/or" as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

What is claimed is:

1. A firearm receiver comprising:

an upper receiver frame;

an inner surface of the upper receiver frame contoured to define a component housing cavity within the upper receiver frame configured to house a shaft portion of a charging handle;

an outer surface of the upper receiver frame contoured to define at least one wear surface cavity penetrating a portion of the upper receiver frame; and at least one wear surface pin secured within the at least one wear surface cavity such that an exposed portion of the wear surface pin is positioned to engage with a charging handle latch.

2. The firearm receiver of claim 1, wherein the at least one wear surface cavity includes two wear surface cavities each one configured to secure a portion of one of the at least one wear surface pin such that an exposed portion of the at least one wear surface pin engages with one of a right handed and/or left handed charging handle latch.

3. The firearm receiver of claim 1, wherein the at least one wear surface pin is composed of a material having higher resistance to wear than a material of the upper receiver frame.

4. The firearm receiver of claim 1, wherein the at least one wear surface pin is composed of a different material than the upper receiver frame.

5. The firearm receiver of claim 1, wherein the at least one wear surface pin comprises at least one of a solid metal pin, a hollow metal pin, a coiled spring pin, and a slotted spring pin.

6. The firearm receiver of claim 5, wherein a portion of the at least one wear surface pin is configured to be pressure-fit within the at least one wear surface cavity.

7. The firearm receiver of claim 1, wherein the at least one wear surface pin is a threaded pin-shaped object configured to be screwed into the at least one wear surface cavity.

8. The firearm receiver of claim 1, wherein the exposed portion of the at least one wear surface pin prevents contact between the charging handle latch and the outer surface of the upper receiver frame.

9. The firearm receiver of claim 1, wherein the outer surface and the inner surface of the upper receiver frame are conformed to access each other via the wear surface cavity.

10. The firearm receive of claim 1, wherein the at least one wear surface pin is secured within the at least one wear surface cavity by assembly to the upper receiver frame.

11. A firearm including the firearm receiver of claim 1.

12. A method of installing a wear surface pin comprising:

forming a wear surface cavity into an upper receiver, wherein the wear surface cavity penetrates a portion of the upper receiver; and inserting a wear surface pin into the wear surface cavity such that a portion of the wear surface pin is exposed and positioned to engage with a charging handle latch.

13. The method of claim 12, wherein forming a wear surface cavity comprises forming two wear surface cavities on opposing sides of the upper receiver, and inserting a wear surface pin comprises inserting two wear surface pins, one into each of the two wear surface cavities such that an exposed portion of each of the two wear surface pins engages with one of a right handed and left handed charging handle latch.

14. The method of claim 12, wherein forming a wear surface cavity comprises drilling or milling a substantially cylindrical cavity configured to receive the wear surface pin.

15. The method of claim 12, wherein forming a wear surface cavity further comprises drilling or milling a countersink at the opening of the wear surface cavity.

16. The method of claim 12, further comprising: removing the wear surface pin from the wear surface cavity; and inserting a second wear surface pin into the wear surface cavity such that a portion of the second wear surface pin is exposed and positioned to engage with the charging handle latch.

17. The method of claim 12, wherein inserting a wear surface pin into the wear surface cavity comprises inserting at least one of a solid metal pin, a hollow metal pin, a coiled spring pin, and a slotted spring pin into the wear surface cavity.

18. A firearm receiver comprising:

an inner surface contoured to define a component housing cavity configured to house a shaft portion of a charging handle; and an outer surface contoured to define a wear surface cavity for securing a portion of a wear surface pin such that an exposed portion of the wear surface pin engages with a charging handle latch.

19. The firearm receiver of claim 18, wherein the outer surface of the firearm receiver is further contoured to define two wear surface cavities, each one configured to secure a portion of one of two wear surface pins such that an exposed portion of each wear surface pin engages with one of a right handed and/or left handed charging handle latch.

20. A firearm including the firearm receiver of claim 18.

21. The firearm receiver of claim 18, wherein the firearm receiver is the upper receiver of a modular rifle.

* * * * *